United States Patent [19]

Pacht

[11] Patent Number: 5,060,862

[45] Date of Patent: Oct. 29, 1991

[54] MAGNETIC SPEED CONTROL FOR SELF-PROPELLED SWIVEL

[75] Inventor: Amos Pacht, Houston, Tex.

[73] Assignee: Butterworth Jetting Systems, Inc., Houston, Tex.

[21] Appl. No.: 467,782

[22] Filed: Jan. 19, 1990

[51] Int. Cl.[5] ..... B05B 3/06

[52] U.S. Cl. ..... 239/252

[58] Field of Search ..... 239/252, 225.1; 188/267

[56] References Cited

U.S. PATENT DOCUMENTS

| | | | |
|---|---|---|---|
| 3,029,028 | 4/1962 | Skerritt | 239/252 |
| 4,439,954 | 4/1984 | Bennett | 51/411 |
| 4,561,605 | 12/1985 | Nakajima | 242/84.52 |
| 4,601,438 | 7/1986 | Young | 188/267 X |
| 4,690,325 | 9/1987 | Pacht | 239/124 |
| 4,704,826 | 11/1987 | Kirkland | 51/411 |
| 4,763,033 | 8/1988 | Charbonnier | 310/105 |

FOREIGN PATENT DOCUMENTS 2217234 10/1989 United Kingdom .

*Primary Examiner*—Andres Kashnikow
*Assistant Examiner*—Kevin Weldon
*Attorney, Agent, or Firm*—Jones, Day, Reavis & Pogue

[57] ABSTRACT

An improved high pressure fluid delivery system has a self-propelled swiveling action with a magnetic speed control. A magnetic rotor assembly is fixed to a rotatable spindle having a nozzle containing head through which high pressure fluid is pumped. Slight angling of the nozzles produces rotational torque which is opposed by the action of the magnetic rotor assembly, the opposition increasing at increasing rotational speeds until an equilibrium rotational speed is achieved. A cylindrically-shaped cage of the magnetic rotor assembly also supports upper and lower bearings to provide for thrust generated by high fluid pressure. The magnetic breaking effect is produced by permanent magnets.

4 Claims, 1 Drawing Sheet

MAGNETIC SPEED CONTROL FOR SELF-PROPELLED SWIVEL

FIELD OF THE INVENTION

The invention relates to a high pressure fluid delivery system which includes a swiveling element which swivels in response to reaction forces from fluid flow.

BACKGROUND OF THE INVENTION

In the prior art, fluid systems are provided in which a high pressure stream of water, i.e., at pressures of 6 to 10,000 pounds or more, are used for many cleaning applications. In some of these systems one or more hand-held valve assemblies or guns are provided, and are connected by a hose to a common outlet of a pump. The guns generally include a housing having a valve therein, a barrel extension for directing the high pressure stream of water through a nozzle to the object to be cleaned, a handle or trigger mechanism for operating the valve, and a relatively unrestricted pressure relief or "dump" outlet for relieving pressure in the assembly when flow through the high pressure nozzle outlet is interrupted by operation of the valve.

In some applications it is desired to have a vertically suspended mechanism. These contain an inlet, a housing rotatably journaled thereon and an internal chamber which passes through a non-rotating portion of the housing and through a rotating portion of the housing leading to one or more outlets in the form of nozzles which provide a high pressure generally downwardly directed spray for cleaning a surface or object. The inlet is connected through suitable hosing or piping to a source of highly pressurized fluid which is usually water and/or water containing detergents or other cleaning agents. In order to avoid spot treatment and promote uniformity the outlet nozzles are generally slightly angled off the vertical axis of the device which through reaction forces creates a turning moment which causes the rotatable element to rotate in response to the reaction forces generated when the fluid is flowing.

A problem is encountered because on the one hand it is desirable to have minimum friction in the rotatable element so as to permit the rotation of the part of the housing containing the outlet nozzles in order to maintain the spray in a generally downward direction without excessive angulation off the vertical, and yet provides sufficient friction so that the rotatable element does not overrotate and turn at excessive speeds. The reaction forces are difficult to estimate and it is difficult to balance the combination of frictional forces and reaction forces so that the rotatable portion of the housing containing the nozzles will rotate but will not overrotate at a excessively high speed.

It was discovered that the incorporation of a specially constructed magnetic rotor assembly on the rotatable spindle prevents the rotating mechanism from accelerating to an undesirably high speed but does not otherwise effect the operation. The magnetic rotor assembly includes permanent magnets which do not require the use of a battery.

SUMMARY OF THE INVENTION

The basic self-propelled swivel for high pressure water applications in vertical orientation is set forth in my U.S. Pat. No. 4,690,325, issued Sept. 1, 1987, entitled "High Pressure Fluid Delivery System" which is incorporated herein by reference. This basic structure has been modified by providing a magnet rotor assembly fixed to the rotatable spindle portion of the swivel assembly. The magnetic rotor assembly is specially designed to fit between the upper and lower bearings which rotatably support the rotatable spindle. The magnetic rotor assembly has a cylindrically-shaped cage having a central opening which is installed by interference fit on the spindle shaft. The cylindrically-shaped cage is non-magnetic and contains radially oriented bores into which are placed cylindrical permanent magnets in a radial array at spaced apart 45° radial axes perpendicular to the main vertical axis "A" of the whole assembly. In order to multiply the effect there are two sets of radially oriented bores one located directly above the other, all of which are radially oriented spaced apart at 45° angles, the axes of which are perpendicular to the the axis of the spindle. The outside periphery of the cylindrically-shaped cage containing the magnets is enclosed by a cylindrical ring cover. Both the cage and the cylindrical ring cover are non-magnetic materials. The non-rotating part of the housing adjacent the cylindrical ring cover has a thin cylindrical ring made of electrically conducting material pressed in the housing, which does not rotate. There is a small air gap between the conductive ring and the cylindrical ring cover so that the caged magnets and cover ring can rotate freely in close proximity to the ring made of conducting material pressed adjacently into the non-rotating part of the housing.

In addition to providing a holder for the magnets the cylindrically-shaped cage serves as a support which holds the upper bearing race in position on the spindle. The lower bearing is positioned by the opposite bore end of the cylindrically-shaped cage and held in position by a cap on the lower most portion of the non-rotatable housing.

When fluid pressure is applied, the spaced apart exit nozzles which are slightly angled initiate rotation of the spindle. The rotating spindle and cylindrically-shaped cage containing the magnets generate eddy currents in the conducting material of the ring which generate magnetic fields believed to interfere with the magnetic fields produced by the permanent magnets. The interfering magnetic fields increase with accelerating speed and so reach an equilibrium rotational velocity at a particular set of operating conditions. Thus the spindle is allowed to rotate but is controlled in its rotation below the ultimate speed it would reach absent the magnets.

DETAILED DESCRIPTION OF THE INVENTION

Figure 1:
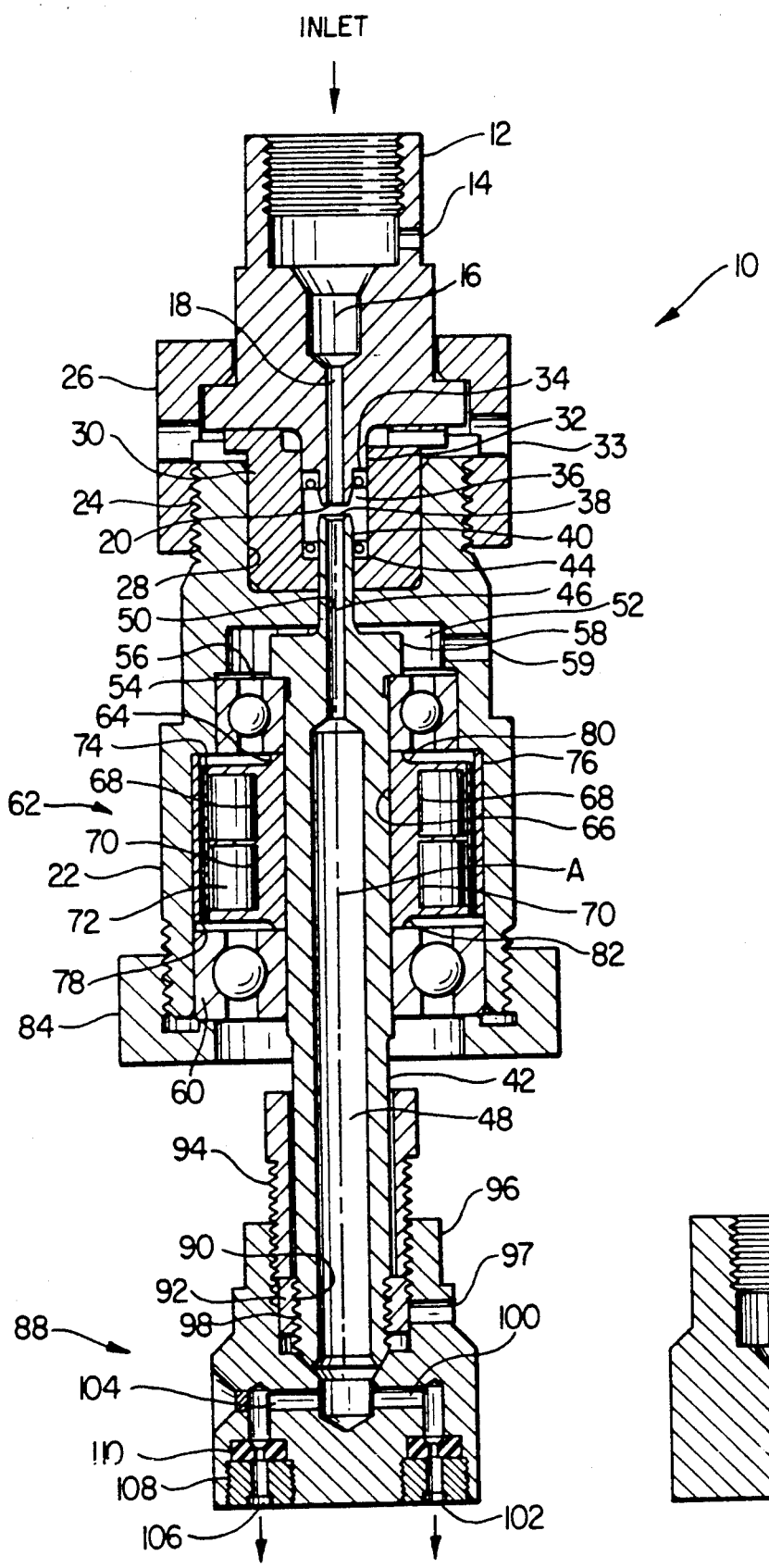
FIG. 1 is a vertical cross-section through the center of the device in its normal vertical operating position.

FIG. 1 is a vertical cross-section through the center of the magnetic speed control for the self-propelled swivel. The swivel is generally designated by the reference numeral 10. The drawing is a scale drawing of one embodiment to illustrate the principles contained in the assembly.

A non-rotating upper housing member 12 has a threaded inlet for connection to a source of high pressure fluid. The inlet through high pressure lines or hoses is connected to a suitable high pressure pump and a source of fluid to be pressurized and fed to the inlet of assembly 10. The fluid to be utilized is normally water or water containing detergents or other cleaning additives or solutions. The assembly 10 is similar to the high pressure fluid delivery system shown in the referenced U.S. Pat. No. 4,490,325, except for the departures therefrom which are disclosed in the improvement herein.

Upper housing 12 has a "weep" opening 14 for pressure relief. "Weep" openings 33, 59 and 97 are also provided in other parts of the assembly and they are understood by those skilled in the art as providing outlets for small amounts of leakage at connections or through seals to prevent pressurizing enclosed portions of the structure. Special high pressure connections are used.

Upper housing 12 has a centrally disposed flared bore 16 which leads to a fluid passageway 18 which terminates in an outlet 20. Assembly 10 further includes a lower non-rotating housing 22 which has an upwardly extending threaded portion 24. A threaded ring 26 engages a shoulder on upper housing 12 and simultaneously engages threaded portion 24 to join the upper and lower housings 12, 22, securely together. Housings 12 and 22 are non-rotatable elements.

Upper portion 24 of lower housing 22 has a large diameter bore 28 which is closely fitted with a seal cartridge 30 which has the same purposes and characteristics as illustrated in FIG. 1 of U.S. Pat. No. 4,690,325. A downwardly protruding tip portion 32 of upper housing 12 extends into and seals with the upwardly extending portion of seal cartridge 30. An upper seal 34 comprises a seal between the downwardly extending tip portion 32 and an interior chamber 36, centrally located in seal cartridge 30. Outlet 20 protrudes into chamber 36.

Also protruding in chamber 36 is a tubular projection 40 of spindle 42. Spindle 42 along with tubular projection 40 are rotatable. Tubular projection 40 is tightly fitted through an opening in seal cartridge 30 and is further sealed by lower seal 44. Tubular projection 40 reaches seal cartridge 30 through a centrally located opening 50 in housing 22. Chamber 36 is thus formed into which pressurized fluid is introduced through outlet 20 which then enters inlet 38 to enter via passageway 46 into the central bore 48 of spindle 42.

Housing 22 has an internal chamber 52 which is cylindrical in shape and has a shoulder 54 for securing an upper bearing 56. Upper bearing 56 rotatably supports spindle 42 for rotation. An enlarged diameter shoulder 58 of spindle 42 engages the inner race of bearing 56 for thrust support. Spindle 42 is also supported in housing 22 by an enlarged lower bearing 60. Bearings 56 and 60 are radial sealed ball bearings which in contrast with U.S Pat. No. 4,690,325 do not need separate external lubrication.

By means of a tight interference fit a magnetic rotor assembly generally designated 62 is fitted to spindle 42 just below upper bearing 56. A cylindrically-shaped cage 64 having a central bore 66 is tightly interference fit and fixed to spindle 42. Cylindrically-shaped; cage 64 has two rows of radially oriented bores spaced apart at 45° angles around the periphery of cage 64, one right above the other. The upper set of bores are designated 68 and the lower set of bores are designated 70. Consequently there are 8 pairs of bore 68, 70 spaced apart on radial axes perpendicular to the central axis "A" of spindle 42 at 45° intervals around the circumference of cage 64.

Into each of the bores 68, 70 in cylindrical cage 64 are fitted cylindrical permanent magnets 72 which are of a "strong" of a high energy type. Magnets 72 have a north pole and a south pole with flat faces and they are held in position by a cylindrical ring cover 74. Ring cover 74 which surrounds in tight fitting contact the outer periphery of cylindrically-shaped cage 64, cover the outside openings of bores 68 and 70 and retain the magnets 72. This may also be accomplished by an interference fit although it is obvious that cover plates or other means could be utilized to hold cover 74 in place to rotate along with the magnets and the cylindrically-shaped cage 64. The magnet holding openings 68 and 70 form pairs which are stacked vertically one above the other. The poles of the magnets 72 in each stacked pair of bores 68, 70 are the same, i.e. either north or south. The poles must alternate with respect to the adjacent next stacked pair of magnet holding bores 68, 70. To put it another way, the poles alternate between north and south orientation between each adjacent magnet 72 in bores 68 as they progress around the circumference of the cage and the same with respect to the magnets in bores 70.

Interferingly fit in the internal chamber 52 of housing 22 is a cylindrical ring of conducting material 76 placed in close proximity to the cylindrical surface of cylindrical ring cover 74 of the magnetic rotor assembly 62. Conducting material 76 is fixed in housing 22 and there is a small air gap 78 between the inside surface of conducting ring 76 and the outside surface of magnetic rotor assembly 62.

Cylindrically-shaped cage 64 adjacent its internal bore further includes bosses 80 and 82. When assembly 62 is interference fit on spindle 42 it slides up against and secures the inner race of upper bearing 56 against shoulder portion 58 of spindle 42. Lower bearing 60 is located on spindle 42 with its inner race in contact with lower boss 82 and it is held in place by threaded ring 84 which engages threads on the lower most part of lower housing 22. This secures the spindle for rotation and provides a means for handling thrust produced by the large pressures in chamber 36, on the order of 10,000 to 20,000 pounds per square inch in operation. This pressure is larger than the reaction force produced by expansion of fluid from the nozzles, therefore the thrust to be accommodated is downwardly directed.

A nozzle block generally designated 88 is connected in sealed relationship on the lower most end of spindle 42. Spindle 42 has a threaded portion 90 to which is fastened a nut 92. A threaded fitting 94 slides over spindle 42 to which is threaded a hollow head 96. Head 96 has a chamber 98 which is flared to seat against the tip end of spindle 42 in sealing relationship. Chamber 98 has at least one passageway 100 leading to at least one nozzle opening 102. Nozzles are produced by screwing a fixture into head 96. In FIG. 1 an additional passageway 104 connected to chamber 98 leads to a second nozzle 106 formed in a threaded insert 108 screwed into head 96. A sealing washer 110 may be used between insert 108 and a bore in head 96.

Figure 2:
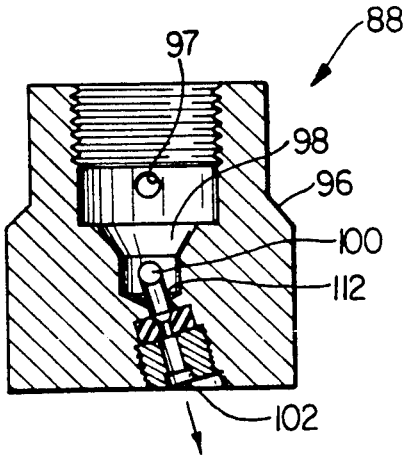
FIG. 2 is a detail cross-section of one of the nozzles taken at a position 90° from the position of the nozzles in FIG. 1.

In FIG. 2 is shown a side view which shows that passageway 100 continues downwardly in an angle portion 112 angled from the vertical axis. Fluid passes through passageway 100 and angled portion 112 to reach nozzle 102. The output of pressurized fluid is indicated by the arrows in FIGS. 1 and 2. The slight angled position of the downwardly extending portion 112 and the nozzle opening 102 is what creates a reaction force torque which causes the rotation of spindle 42. Without the magnetic speed control provided by the magnetic rotor assembly on spindle 42, and because of the lack of much air resistance, the self-propelled rotation of the rotating swivel components on spindle 42 could accelerate to such a degree that vibration and various other forces could actually destroy the swivel assembly.

In operation, pressurized fluid enters the inlet, passes through chamber 16, passageway 18, chamber 36, central opening 50, central bore 48, chamber 98, passageway 100 and exits through nozzles 102, 106. FIG. 1 shows two equally spaced nozzles although it is possible to use only one nozzle or more than two nozzles. The head 96 is replaceable not only to replace worn or damaged nozzles but also to select a head with a more appropriate angle of the nozzle from the vertical. The amount of rotational force generated by the passage of fluid through the assembly 10 will depend not only upon the number of nozzles and the angle of the axis of the nozzle from the vertical, but also by the amount of friction in the assembly and especially by the size of the openings in the nozzle and the amount of pressure applied to the pressurized fluid. It must be appreciated that pressures as high as 20,000 pounds per square inch are utilized in this type of high pressure swivel which change the rotational torque generated.

The seal cartridge is preferably made from an aluminum bronze metal and the spindle is made from magnetic stainless steel. The cylindrically-shaped cage and the cylindrical ring cover of the magnetic rotor assembly are made from a non-magnetic material, preferably aluminum. The conducting material in ring 76 is made of copper which is pressed into the housing. Applicant believes the better conductivity of copper as compared to bronze is desirable. In the particular embodiment illustrated in FIG. 1 the copper ring was about 1/16 inch thick with an outer diameter of about 1 and 13/16 inches. The air gap between the cylindrical ring of conducting material and the outer circumference of the surface of the magnetic rotor assembly should be as close as possible without rubbing. A small air gap of approximately 0.02 inches has been found satisfactory. An enlarged lower bearing 60 has been provided to better accommodate the thrust and still use a radial bearing which does not need an external lubrication system. It is desirable to use strong magnets in the magnetic rotor assembly in order to maintain the compactness of the unit. Neadymium magnets have been used successfully although they are somewhat sensitive to heat generated, and less heat sensitive magnets would be desirable. A high energy magnet is desirable. The strong magnets make a more compact assembly possible.

It is believed that the magnetic breaking action arises because of eddy currents generated which create magnetic fields in opposition to the fields of the permanent magnets and in this regard it should be noted that the lower housing 22 is made of magnetic material. The exact mechanism of the magnetic braking provided by the magnetic rotor assembly is not completely understood. The beauty of the action of the magnetic rotor assembly is that the magnetic breaking action increases automatically as the rotational speed increases, which generates an increasing counter torque to the torque provided by the nozzles, presumably because more eddy currents are generated. Consequently the unit reaches an equilibrium rotational velocity and stays constant for a particular set of operating conditions.

Another significant advantage of the magnetic structure illustrated in FIG. 1 of the drawings is the fact that the permanent magnets 72 and the cooperating non-magnetic, electrically conductive sleeve 76 are disposed intermediate the two axially spaced antifriction bearing units 56 and 60. Thus variations in the air gap defined between the radially outer ends of the permanent magnets 72 by the inherent vibrations produced by the high speed rotation of the hollow spindle 42, and by localized heating of the conductive sleeve 76, are minimized.

Also the provision of seal 44 and venting port 59 minimizes the action of water on upper ball bearing 56 that may leak through seal 44, hence minimizing flow of water into the magnetic air gap.

The foregoing detailed description if to be clearly understood as given by way of illustration and example only, the spirit and scope of this invention being limited soleley, by the appended claims.

What is claimed is:

1. In a self-propelled high pressure fluid delivery assembly of the type having a non-rotating housing connectable to a source of high pressure water;

a pair of anti-friction bearings having inner and outer ring portions means for securing said outer ring portions of said anti-friction bearings in said hollow housing in axially spaced relation;

a rotatable hollow spindle secured to said inner ring portions of said anti-friction bearings;

said hollow spindle being formed of magnetic material intermediate said bearings;

a plurality of permanent magnets;

said hollow spindle having an axial entering end for receiving the high pressure water and an axial discharge end;

non-magnetic means for mounting said plurality of magnets for rotation with said spindle in circumferentially spaced relationship and intermediate said anti-friction bearings;

a sleeve of electrically conducting, non-magnetic material mounted in said hollow housing intermediate said anti-friction bearings and in close proximity to the rotational path of said magnets; and means for producing rotation of said hollow spindle by high pressure water discharged from said discharge end.

2. The apparatus of claim 1 wherein said hollow housing defines a high pressure water receiving chamber above the uppermost one of said anti-friction bearings;

said hollow spindle having a reduced diameter portion projecting upwardly into said chamber; and seal means in said chamber for minimizing leakage flow around said seal means into said uppermost anti-friction bearing.

3. The apparatus of claim 2 further comprising vent means above said uppermost anti-friction bearing for venting leakage water to the exterior of said housing.

4. The apparatus of claim 1 where said permanent magnets are of cylindrical configuration with the north and south magnetic poles respectively located at the opposite end faces;

said magnets being arranged with the north and south pole ends being circumferentially adjacent, whereby each pair of magnets defines a flux path radially traversing said air gap and said electrically conductive sleeve.

* * * * *